US007893633B2

(12) United States Patent
Pedersen

(10) Patent No.: US 7,893,633 B2
(45) Date of Patent: Feb. 22, 2011

(54) METHOD AND APPARATUS FOR CONTROLLING A VARIABLE-COLOUR LIGHT SOURCE

(75) Inventor: Allan Pedersen, Aarhus C (DK)

(73) Assignee: Martin Professional A/S, Aarhus N (DK)

( * ) Notice: Subject to any disclaimer, the term of this patent is extended or adjusted under 35 U.S.C. 154(b) by 887 days.

(21) Appl. No.: 11/814,190

(22) PCT Filed: Dec. 1, 2006

(86) PCT No.: PCT/DK2006/000683

§ 371 (c)(1),
(2), (4) Date: Jul. 18, 2007

(87) PCT Pub. No.: WO2007/062662

PCT Pub. Date: Jun. 7, 2007

(65) Prior Publication Data

US 2009/0284177 A1 Nov. 19, 2009

(30) Foreign Application Priority Data

Dec. 1, 2005 (DK) ..... 2005 01701

(51) Int. Cl.
*H05B 37/00* (2006.01)

(52) U.S. Cl. ..... 315/318; 315/312; 315/297; 315/307; 345/77; 345/83; 345/46

(58) Field of Classification Search ..... 315/312, 315/318, 292, 295, 297, 169.1, 169.3, 307; 345/46, 63, 77, 78, 81–83
See application file for complete search history.

(56) References Cited

U.S. PATENT DOCUMENTS

| | | | | |
|---|---|---|---|---|
| 6,473,062 | B1 * | 10/2002 | Debiez et al. | 345/63 |
| 6,894,442 | B1 | 5/2005 | Lim et al. | |
| 6,965,205 | B2 * | 11/2005 | Piepgras et al. | 315/318 |
| 6,967,447 | B2 | 11/2005 | Lim et al. | |
| 7,023,543 | B2 | 4/2006 | Cunningham | |
| 7,202,613 | B2 | 4/2007 | Morgan et al. | |
| 2004/0105261 | A1 | 6/2004 | Ducharme et al. | |
| 2004/0245946 | A1 | 12/2004 | Halter | |

FOREIGN PATENT DOCUMENTS

WO 2006/091398 A2 8/2006

* cited by examiner

*Primary Examiner*—Haissa Philogene
(74) *Attorney, Agent, or Firm*—Roberts Mlotkowski Safran & Cole, P.C.; David S. Safran

(57) ABSTRACT

Disclosed is a control device for controlling a variable-color light source, the variable-color light source comprising a plurality of individually controllable color light sources. The control device comprises a control unit for generating, responsive to an input signal indicative of a color and a brightness, respective activation signals for each of the individually controllable color light sources. The control unit is configured to generate the activation signals from the input signal and from predetermined calibration data indicative of at least one set of color values for each of the individually controllable light sources.

10 Claims, 4 Drawing Sheets

METHOD AND APPARATUS FOR CONTROLLING A VARIABLE-COLOUR LIGHT SOURCE

BACKGROUND OF THE INVENTION

1. Field of the Invention

The present invention relates to the calibration of a variable-colour light source that allows the provision of coloured light of a selectable brightness and/or colour by means of a plurality of individually controllable light sources.

2. Description of Related Art

Colour light sources for generating light of variable colour and/or intensity are widely used in the entertainment industry, e.g. for stage illumination etc., and for other purposes within lighting design, e.g. to provide lighting effects in architecture, etc.

Typically, such variable colour light sources comprise a plurality of individually controllable light sources such that each individually controllable light source emits light of a predetermined colour. For example, in an RGB system, the variable-colour light source may comprise individually controllable light sources of the most common primary colours—red, blue, and green. By controlling the relative brightness of the respective individually controllable light sources of the different primary colours almost any colour in the visible spectrum may be generated by means of an additive mixing of the respective primary colours, resulting in output light of the desired colour and intensity.

US20040160199A1 describes lighting units of a variety of types and configurations, including linear lighting units suitable for lighting large spaces, such as building exteriors and interiors. Also provided herein are methods and systems for powering lighting units, controlling lighting units, authoring displays for lighting units, and addressing control data for lighting units.

US20050134202A1 concerns a light source having N light generators, a receiver, and an interface circuit. Each light generator emitting light of a different wavelength, the intensity of light generated by the light generator is determined by a signal Ik coupled to that light generator. The receiver receives a color coordinate that includes N color components, Ck, for k=1 to N, wherein N is greater than 1. The interface circuit generates the Ik for k=1 to N from the received color components and a plurality of calibration parameters. The calibration parameters depend on manufacturing variations in the light generators. The calibration parameters have values chosen such that a light signal generated by combining the light emitted from each of the light generators is less dependent on the manufacturing variations in the light generators than a light signal generated when Ik is proportional to Ck for k=1 to N.

U.S. Pat. No. 6,967,448 discloses a multi-colour LED-based light assembly, where different coloured LEDs are individually controlled by means of respective pulse width modulated current control. For instance, this prior art system allows a user to control such a variable-colour light source to generate light at different colours by means of three individual potentiometers, each controlling LEDs of a respective colour.

However, due to the varying characteristics and potential non-linearity of the individual light sources, it is difficult to obtain a precise colour control at different brightness values. This typically requires a cumbersome manual adjustment of the individual sources or a complicated and costly feed-back control of the light sources. For example, it is cumbersome to control the individual potentiometers such that the overall brightness of a variable-colour light source assembly is varied while keeping the colour (e.g. the hue and saturation) constant.

WO 2006/091398 concerns a manufacturing process for storing measured light output internal to an individual LED assembly, and an LED assembly realized by the process. The process utilizes a manufacturing test system to hold an LED light assembly at a controlled distance and angle from the spectral output measurement tool. Spectral coordinates, forward voltage, and environmental measurements for the as a manufactured assembly are measured for each base color LED. The measurements are recorded to a storage device internal to the LED assembly. These stored measurements can then be utilized in usage of the LED assembly to provide accurate and precise control of the light output by the LED assembly.

The WO document describes a linear relation for a LED in that a baseline is found during calibration. The behaviour of the LED is predicted from the baseline. This prediction can only for a limited use of the LED, because LEDs are unlinear components. Further, it is not effective to calibrate LEDs during the manufacturing process, simply because the internal heating in the LED depends of the actual cooling. An effective calibration can therefore first be performed after the LED is in operation in the actual use.

WO 2006/091398 was filed but not published before the filing date of the pending application.

SUMMARY OF THE INVENTION

The above and other problems are solved by a control device for controlling a variable-colour light source, the variable-colour light source comprising a plurality of individually controllable colour light sources; where the control device is responsive to an input signal, which input signal is indicative of a colour and a brightness, where the control device comprises a control unit for generating, respective activation signals for each of the individually controllable colour light sources; wherein the control unit is configured to generate the activation signals from the input signal and from predetermined calibration data indicative of at least one calibration colour vector in a predetermined colour space and at least one brightness response mapping for each of the individually controllable colour light sources.

Hereby can be achieved that a calibration can be performed at a manufacturing operation where calibration data for adjusting, e.g. a LED into operation in accordance with a colour vector, is performed. These calibration data can for each LED be stored in the control unit, and in operation the control unit can adjust the LEDs in accordance with the calibrated colour vector. If the control unit is also able to calculate or measure the temperature of operation or LEDs, it is also possible according to the temperature to perform further calibrations into the correct colour vector. Deviations in LEDs according to wear out over use for long periods are well known and as such wear out data can also be part of the calibration. This can lead to a control of a LED-system where correct colour performance is achieved independently of change in temperature or by wear out. Consequently, by generating the activation signals from the input signal and from predetermined calibration data indicative of at least one set of colour values for each of the individually controllable light sources, an efficient and accurate colour control is provided. In particular, a control device is provided that can map an input colour and brightness signal to a plurality of activation signals without the need for further manual fine-tuning. Accordingly, a variable-colour light source may be controlled by means of a corresponding input colour and/or brightness signal that defines the desired colour and/or brightness of the resulting output light, and the control device thus automatically controls the variable-colour light source to accurately reproduce the desired colour irrespectively of the desired brightness. It is a further advantage of the device and method described herein that it does not require any complicated feed-back mechanism. Once calibrated, the control device may be implemented as a feed-forward control circuit that can be implemented in a cost-effective manner. It is preferred that, the calibration data is indicative of at least one calibration colour vector in a predetermined colour space and at least one brightness response mapping for each of the individually controllable colour light sources. Consequently, an accurate calibration is provided while keeping the number of calibration parameters small, thereby providing an efficient calibration process and reducing the required computational resources in the control device.

In some embodiments, the control device is configured to obtain an input colour vector indicative of the received colour and brightness;

to determine at least one component of the input colour vector along at least one of the calibration colour vectors; and to apply a corresponding one of the brightness response mappings resulting in a corresponding one of the activation signals.

It is an advantage of the control device and method described herein that it compensates for non-linearities of the individual colour light sources, thereby providing an accurate colour control over a wide range of colours and brightness values.

When the calibration data is indicative of at least two colour vectors in a predetermined colour space for each of the individually controllable colour light sources, colour variations of the individual light sources at different activation levels are effectively compensated for. This is particularly advantageous in connection with light sources, such as fluorescent tubes, that tend to change colour depending on the brightness.

When the control device comprises storage means for storing said calibration data, the control device may—once calibrated—be used as a stand-alone unit without the need for additional control inputs. The storage means may comprise any suitable device or circuit for storing data. Examples of suitable storage means include a ROM, a PROM, an EPROM, an EEPROM, a flash memory, an optical disk, a CD, a DVD, a floppy disk, a hard disk, a magnetic tape, or any other suitable storage medium.

When the control device comprises an input interface for receiving said calibration data, the control device may easily be (re-)calibrated by loading new/updated calibration data into the device. The input interface may include any suitable device or circuitry for receiving a data signal. Examples of suitable interfaces include a serial port, such as an USB port, an infrared (e.g. IrDA) port, a radio-frequency (e.g. a Bluetooth) receiver, or any other wired or wireless connection. In some embodiments, the input interface may be embodied as a storage medium that may be removably inserted in the device, e.g. a floppy disk, a memory card, a smart card, a memory stick, a CD, a DVD, or the like.

The calibration of the individually controllable light sources may be performed with respect to a number of colour systems/colour spaces, e.g. an RGB colour space and HSI (hue-saturation-intensity) colour space, a CMY colour space, a CIE colour space, or the like.

In some embodiments, the calibration is performed with respect two all dimensions in the respective colour space, e.g. with respect to three dimensions. In alternative embodiments, the calibration is performed with respect to a subset of the dimensions of the corresponding colour space only. In one embodiment, the calibration is performed in the HSI colour system with respect to the hue and the intensity/brightness, while keeping the saturation fixed, e.g. at substantially 100%. In particular, in one embodiment, an accurate calibration is provided when the calibration data includes, for each of the individually controllable light sources, a first calibration parameter indicative of at least one of a measured hue and a measured saturation value of the individually controllable light source. Preferably, the calibration data further includes, for each of the individually controllable light sources, second and third calibration parameters indicative of a brightness scaling function of the individually controllable light source.

In some embodiments, the control device comprises an input interface for receiving a temperature signal, and the control unit is further adapted to compensate the generated activation signals responsive to said temperature signal. Consequently, the control device provides a further improved accuracy of the colour control even at changing temperature conditions.

The individually controllable colour light sources may be light emitting diodes (LEDs), fluorescent tubes, white light sources with a corresponding subtractive colour filter, or any other suitable light sources for generating different coloured light.

The present invention can be implemented in different ways including the control device described above and in the following, a control method, a calibration method, a calibration system, a variable-colour light source, and further product means, each yielding one or more of the benefits and advantages described in connection with the first-mentioned control device, and each having one or more preferred embodiments corresponding to the preferred embodiments described in connection with the first-mentioned control device and/or disclosed in the dependant claims.

In particular, according to one aspect, a method of controlling a variable-colour light source, the variable-colour light source comprising a plurality of individually controllable colour light sources, comprises:

receiving an input signal indicative of a colour and a brightness; and generating, responsive to the received input signal, respective activation signals for each of the individually controllable colour light sources;

wherein generating includes generating the activation signals from the input signal and from predetermined calibration data indicative of at least one set of colour values for each of the individually controllable light sources.

According to a further aspect, a method of calibrating a variable-colour light source, the variable-colour light source comprising a plurality of individually controllable colour light sources, comprises:

providing an input signal indicative of a colour and a brightness to the variable-colour light source;

receiving a colorimetric measurement signal indicative of a set of measured colour values emitted by the variable-colour light source in response to the input signal.

determining calibration data from the input signal and the received colorimetric measurement.

It is noted that the features of the methods described above and in the following may be implemented in software and carried out on a data processing system or other processing means caused by the execution of program code means such as computer-executable instructions. Here and in the following, the term processing means comprises any circuit and/or device suitably adapted to perform the above functions. In particular, the term processing means comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

For example, the program code means may be loaded in a memory, such as a Random Access Memory (RAM), from a storage medium or from another computer/computing device via a computer network. Alternatively, the described features may be implemented by hardwired circuitry instead of software or in combination with software. The program code means may be embodied as a computer-readable medium having stored thereon said program code means, such as optical disks, hard disks, floppy disks, tapes, CD ROMs, flash memory, memory sticks, and/or other types of magnetic and/or optical storage media.

According to yet a further aspect, a calibration system for calibrating a variable-colour light source, the variable-colour light source comprising a plurality of individually controllable colour light sources, comprises:

a control unit adapted to provide an input signal indicative of a colour and a brightness to the variable-colour light source;

a colorimetric sensor adapted to measure a set of measured colour values emitted by the variable-colour light source in response to the input signal;

wherein the control unit is further adapted to determine calibration data from the input signal and the measured colour values.

According to yet a further aspect, a variable-colour light source assembly comprises a plurality of individually controllable colour light sources and a control device as disclosed herein.

The above and other aspects will be apparent and elucidated from the embodiments described in the following with reference to the drawings in which:

DETAILED DESCRIPTION OF THE INVENTION

Figure 1:
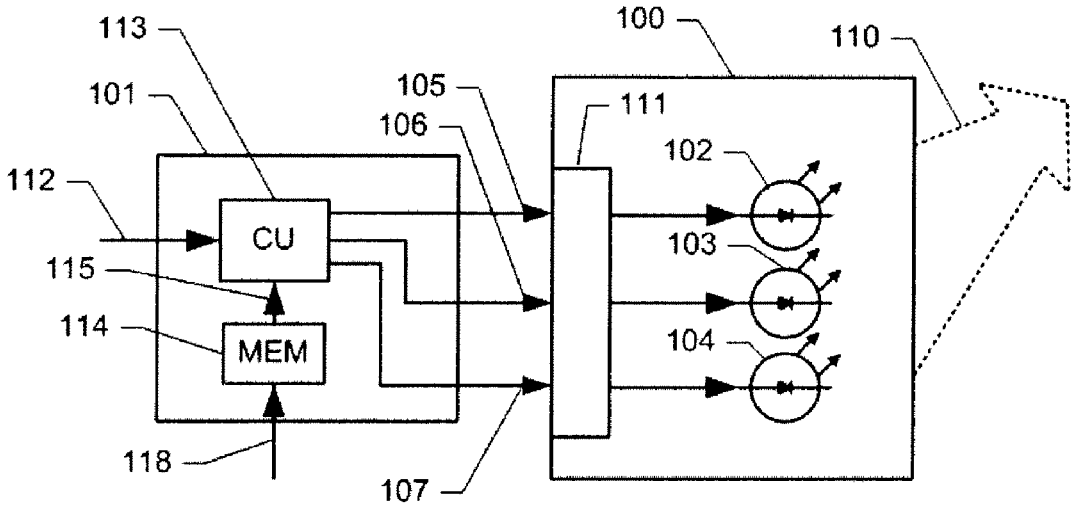
FIG. 1 schematically shows a block diagram of an embodiment of a variable-colour light source with a control device.

In the drawings like reference numbers refer to like or corresponding components, features, entities, etc.

FIG. 1 schematically shows a block diagram of an embodiment of a lighting system. The system includes a variable-colour light source 100 and a control device 101 for controlling the variable-colour light source 100.

The variable-colour light source includes a plurality of different individually controllable coloured light sources 102, 103, 104, each for emitting light of a predetermined respective colour that additively mix resulting in overall emitted light 110. For example, the variable-colour light source 100 may include one or more individual light sources of each of the primary colours red, blue and green. In the example of FIG. 1, three light sources are shown. It is understood, however, that a variable-colour light source may include a different number of different-coloured light sources. For example, some systems include light sources of additional colours in addition to the primary colours, e.g. an amber light source, a white light source, and/or the like. Furthermore, it will be appreciated that each individual light source may itself include a plurality of light sources, e.g. an array of LEDs of like colour, that are controlled by the same activation signal.

The variable-colour light source 100 receives respective activation signals 105, 106, 107, each activation signal controlling one of the individually controllable light sources 102, 103, and 104, respectively. It is understood, that the activation signals may be received as separate signals, e.g. via separate electrical connections, or as a single signal, e.g. a binary data signal, encoding the respective activation levels for the individual light sources. The variable-colour light source 100 includes a control circuit 111 that receives the activation signals and controls the individual light sources. In particular, the control circuit transforms the activation signals into control signals suitable for the light sources 102, 103, and 104. For example, in an LED-based embodiment, the individual LEDs may be controlled by a pulse width modulated current. In some embodiments, the control device 101 may be adapted to generate activation signals 105, 106, and 107 which may directly be fed to the respective light sources 102, 103, and 104, thereby avoiding the need for a further control circuit 111.

The control device 101 receives a control input signal 112, typically a colour vector expressed in a suitable colour system, e.g. the RGB system, the CMY system, the HSI (Hue-Saturation-Intensity) system, or the like. The colour vector 112 thus includes information of the desired absolute colour of the output light 110 and the desired light brightness (e.g. as a relative intensity between 0 and a maximum intensity available/selected for a given light source). For example, in the HIS system, a colour vector includes a hue value, an intensity value and a saturation value. Hence, in the HIS system, the brightness is determined by one of the three vector components, namely the intensity component.

The control device includes a control unit 113, e.g. a suitably programmed microprocessor that translates the received colour vector 112 into activation signals 105, 106, and 107 to the respective individual light sources 102, 103, and 104, the activation signals being indicative of respective activation levels of the individually controllable colour light sources. The translation between the desired colour vector 113 and the activation signals 105, 106, and 107 includes a transformation based on calibration data obtained during a calibration process described herein and stored in a non-volatile memory 114 of the control device. In general, the calibration data defines a mapping from the input colour vector to the activation levels for the individual light sources. The mapping may be stored in a variety of different ways, including a function call, as a look-up table, or in any other suitable way.

If the input signal 112 is related to a different colour space than the activation signals 105, 106, and 107, the translation may further include a transformation from one colour system to another. For example, it may be convenient for a user to specify the desired colour vector 112 in the HIS system, while the activation signals may conveniently relate to the RGB system when the individual light sources 102, 103, and 104 are coloured in the respective primary colours red, blue and green of the RGB system.

Figure 2:
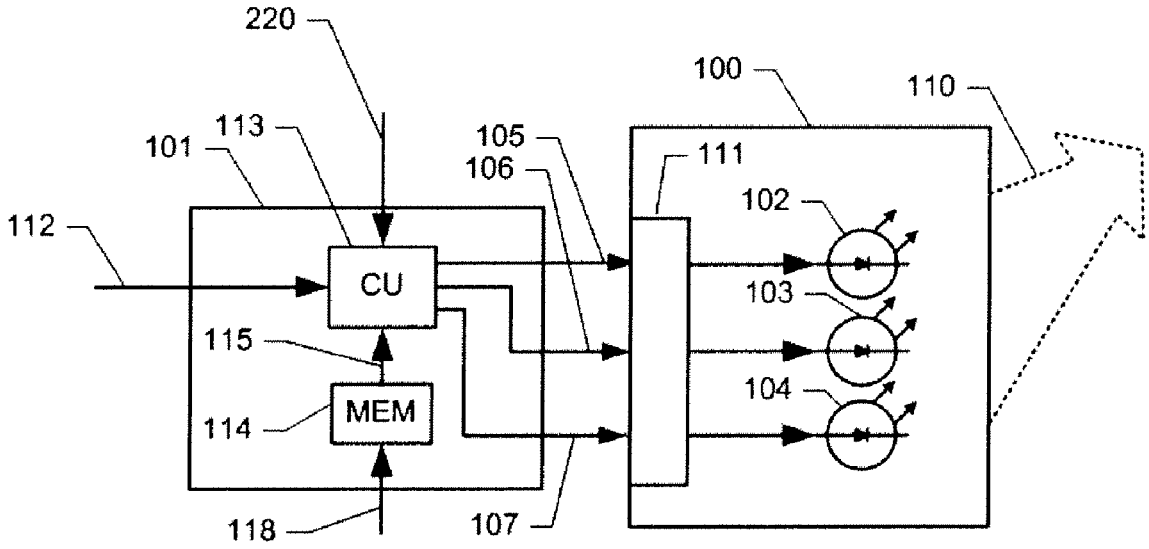
FIG. 2 schematically shows a block diagram of another embodiment of a control device for a variable-colour light source.

FIG. 2 schematically shows a block diagram of another embodiment of a control device for a variable-colour light source. The control device of FIG. 2 is similar to the control device described in connection with FIG. 1. However, in this embodiment, the control unit 113 of the control device 101 further receives a temperature signal 220 indicative of the current temperature of the variable-colour light source controlled by the control device 101. For example, the control device 101 may receive the temperature signal from a temperature sensor positioned in a suitable proximity of the variable-colour light source. Based on the temperature signal, the control unit 113 performs a temperature compensation in addition to the compensation based on the calibration data described herein. Since the colour and/or brightness of many light sources, e.g. LEDs, are known to be temperature dependant, such as temperature compensation further improves the accuracy of the colour control. Many manufacturers of light sources provide a specification of the temperature dependence of the corresponding light source, e.g. as a table of compensation factors. In some embodiments, the specified temperature compensation data is thus stored in the memory 114 of the control device. Accordingly, during operation, the control device 101 receives a current temperature signal 220, retrieves corresponding compensation data from the memory, and compensates the activation signals 105, 106, and 107 accordingly, e.g. by multiplying the respective activation signals with a suitable compensation factor, or by performing any other suitable compensation function.

It will be appreciated that the control device 101 may be further adapted to receive alternative or additional signals and/or data relevant for the calibration/compensation of the activation levels for the light sources. For example, the control device may receive a signal indicative of the accumulated activation time of one or more of the light sources. Alternatively or additionally, the control device may receive other signals, e.g. a clock signal, thus allowing the control device to determine the time elapsed since the previous calibration and to alert a user when a re-calibration of the control device is recommendable.

Generally, the control device described herein may be implemented in different ways, for example as a control circuit integrated in a variable-colour light source product, as a circuit board module that may be inserted in a variable-colour light source product, as a suitably programmed computer, e.g. a personal computer with a suitable output interface for generating an activation signal, as a special purpose external conversion device that may be inserted between a conventional light control system and the variable-colour light source to be controlled, or the like.

As mentioned above, the characteristic functions used by the control device 101 are obtained by an initial calibration process for the particular variable-colour light source 100. Embodiments of the calibration process will now be described with reference to FIGS. 3-5.

Figure 3:
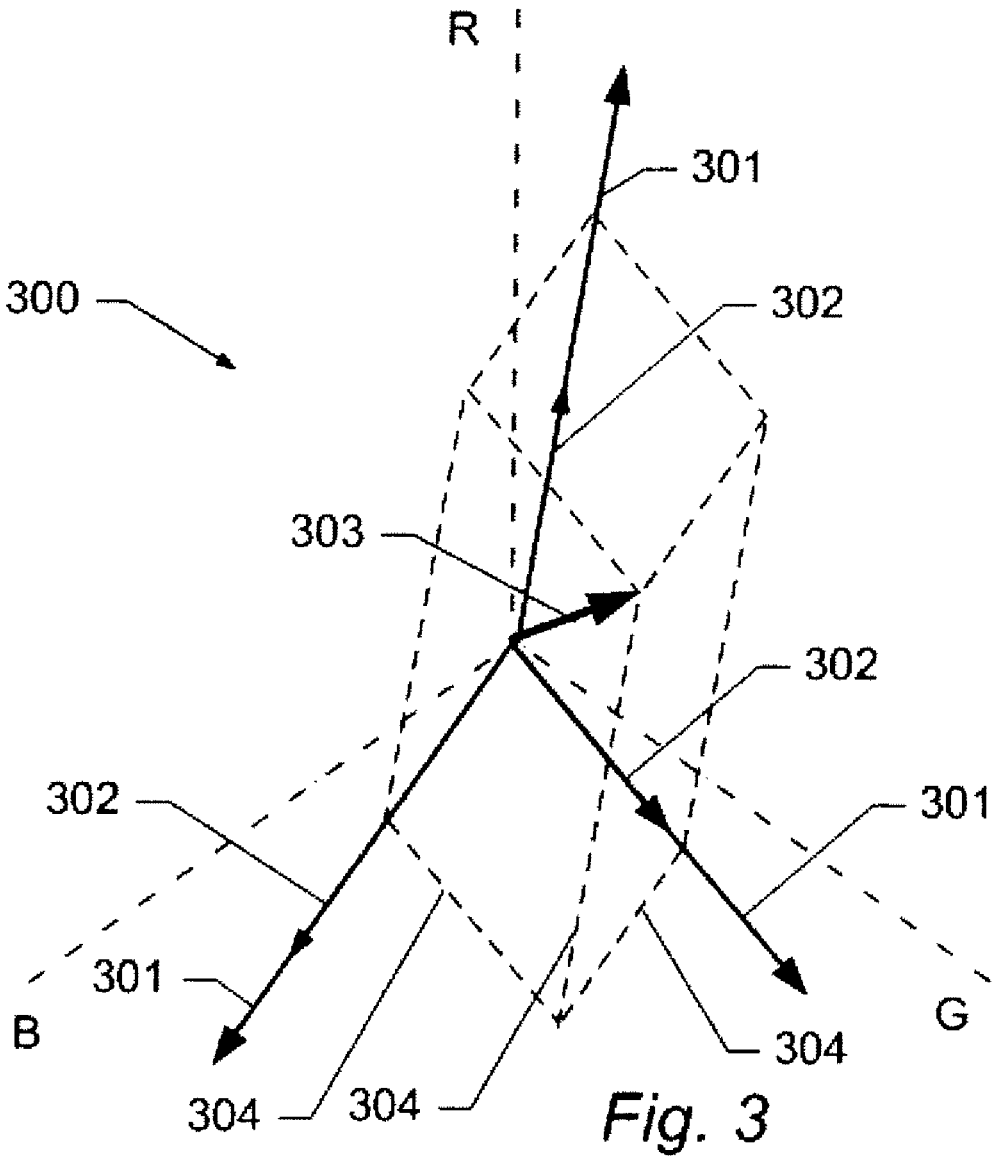
FIG. 3 schematically illustrates an example of the calibration of a variable-colour light source.

FIG. 3 schematically illustrates an example of the calibration of a variable-colour light source. During an embodiment of the calibration process, the individually controllable light sources of a variable-colour light source are activated one by one at predetermined activation levels, preferably such that only one individually controllable light source is activated at a time. A colorimetric light detector is placed such that it receives the resulting output light of the variable-colour light source. The light detector detects the generated light intensity for each individually controllable light source at each of a set of different activation levels, and the colour of the emitted light for at least one activation level per individually controllable light source. For the purpose of the example of FIG. 3, it is assumed that the colour and brightness is determined at a predetermined maximum intensity for each individually controllable light source, and an additional brightness measurement is performed for each individually controllable light source at approximately 50% of the maximum intensity. In one embodiment, the predetermined maximum intensity is set based on the respective nominal maximum intensities of the different individual light sources in the variable-colour light source. In particular, the maximum intensity may be selected as the smallest nominal maximum intensity of all the individually controllable light sources of the variable colour light source (or a predetermined fraction of the smallest nominal maximum intensity, e.g. 95%). It has turned out that a calibration based on two intensity measurements and a single colour measurement per individually controllable light source yields an accurate yet resource-efficient calibration. Nevertheless, it is understood that a calibration may also be performed based on a different number of measurements and/or measurements at different activation levels. From these measurements a model of the set of individually controllable light sources is generated as illustrated in FIG. 3.

FIG. 3 illustrates a 3-dimensional RGB colour space, generally designated 300, where the RGB colours are illustrated by axes R, G, and B. The above colour measurements of the generated light with only one of the individually controllable different-coloured light sources activated at a time and at a predetermined maximum activation level (e.g. an activation level corresponding to a predetermined maximum intensity/brightness as described above) thus results in respective colour calibration vectors 301 for each individual light source. In the RGB colour space 300, the colour calibration vectors 301 are conveniently represented by their respective angles with respect to these axes and by their respective length. The orientation and length of each vector 301 is thus determined by the above-mentioned colour and intensity/brightness measurement.

It is understood that the calibration colour vectors 301 may be represented in any suitable colour system. For example, in one embodiment, the calibration vector is represented in the HSI system. In the HSI system, for a given intensity/brightness, the calibration vector is thus determined by its hue value and its saturation value. Furthermore, in one embodiment, the calibration is only performed for one of the above colour dimensions in addition to the intensity/brightness calibration. In particular, it has turned out that a calibration based on a measured hue value, e.g. at maximum saturation, provides a high degree of accuracy. Hence, in this case, the calibration vector 301 is represented by its hue value and its brightness value alone.

As mentioned above, the above example of a calibration process includes an additional brightness measurement at a smaller activation level for each of the individually controllable light sources. In the present embodiment, it is assumed that the colour of the individual light sources do not depend on the activation level. In particular, for LED-based light sources this has proven to be a reasonable approximation, thereby allowing the calibration to be limited to a single colour measurement for each of the different-coloured light sources and a plurality of brightness measurements.

The additional brightness measurements at a smaller activation level are thus represented as calibration vectors 302 that are parallel to the respective vectors 301 obtained at full intensity, but with a smaller length.

Due to non-linearities of the individual light sources the lengths of the vectors corresponding to 50% activation level do usually differ from half the length of their corresponding full-intensity vector. In the example of FIG. 3, intensities at 50% activation levels are illustrated as vectors 302. Intensities at intermediate levels can then be determined by a suitable scaling function parameterised by or fitted to the measured intensities. Generally, the functional form of the scaling function may be selected according to the characteristics of the individual light source, preferably such that the scaling function corresponds to an inverse of a characteristic function of the individual light source. An example of a suitable scaling function that corresponds well to the human perception of brightness is an exponential function.

In one embodiment, the scaling function has the following form:

$$O_{scaled}=O_{max}\cdot I_{in}\cdot e^{S\cdot(I_{in}-1)},$$

where $I_{in}$ is the relative desired output intensity/brightness of the given individual light source, i.e. wherein $0\leqq I_{in}\leqq 1$ corresponds to the above-mentioned selected maximum intensity. $O_{scaled}$ is the scaled/calibrated activation level, and $O_{max}$ and S are two calibration parameters obtained during calibration: During a first measurement, $O_{max}$ is determined from the measurement at the selected maximum intensity ($I_{in}=1$), i.e. $O_{max}$ is determined as the activation level that results in a measured light intensity/brightness substantially equal to the selected maximum intensity. Subsequently, during a second measurement, the parameter S is determined such that $O_{scaled}$ for $I_{in}=0.5$ (and the determined value for $O_{max}$) corresponds to the activation level that results in a measured brightness/intensity substantially equal to 50% of the above-selected maximum intensity. It is understood that the procedure may also be performed with a different selected maximum intensity and/or with a different second relative intensity, i.e. different from 50% of the maximum intensity (corresponding to a different input $I_{in}$, different from 0.5 in the second measurement).

The orientation (angles) and scaling function (e.g. represented by the parameters $O_{max}$ and S) for each individual light source are thus obtained by this calibration process and stored in the non-volatile memory of the control device. Similarly, in an embodiment, where the calibration vectors are represented in the HIS system, the calibration data comprises the hue value and, optionally, the saturation value for each individual light source in addition to the scaling function as described above.

For any given desired colour vector—e.g. vector 303 in FIG. 3—activation levels for the individual light sources that are required to produce light corresponding to the desired colour vector 303 can be determined as a linear combination of the scaled calibration vectors generated during the calibration process. This is possible, since the calibration process effectively provides a linearization of the individual light sources.

Hence, once calibrated, a control process receives an input colour vector, e.g. an absolute colour vector of a predetermined colour system, e.g. a UV system, a CMY system, an HSI system, an RGB system, an CIE system, such that the colour vector is indicative of an absolute colour and a relative intensity, e.g. expressed at an arbitrary intensity scale between 0 and a $I_{max}$, e.g. between 0 and 1.

In an initial step, if the input vector is represented in a different colour system than RGB, the control process transforms the colour vector into an RGB vector 203. Similarly, in embodiments, where the calibration vectors are represented in a different colour system, e.g. the HIS system, the input vector is transformed accordingly if applicable.

Subsequently, the control process determines the components 304 of the input RGB colour vector 303 relative to the calibration vectors 301. If the number of calibration vectors in the calibration data is equal to the dimension of the colour space, e.g. three calibration vectors in a three-dimensional RGB space, the components 304 along the directions of the calibration vectors 301 are uniquely defined. If the number of calibration vectors is smaller than the dimension of the colour space, e.g. two calibration vectors in the case of a variable-colour light source with only two different-coloured light sources, only a part of the colour space is spanned by the calibration vectors, and only a corresponding subset of colours can be generated by the variable-colour light source. If, on the other hand, the variable-colour light source includes more than three different coloured light sources—e.g. an amber LED and/or a white LED in addition to LEDs in the three primary colours red, blue, and green—the number of calibration vectors may exceed the dimension of the colour space. In this situation, an input colour vector 303 can be represented in terms of components along the directions defined by the calibration vectors in more than one way. In this situation, the control process selects one of the possible representations according to a predetermined selection criterion. For example, the process may select a representation with respect to a subset of the calibration vectors that results in the largest maximum brightness along the direction in colour space defined by the input vector. This criterion is illustrated in FIG. 4.

Figure 4:
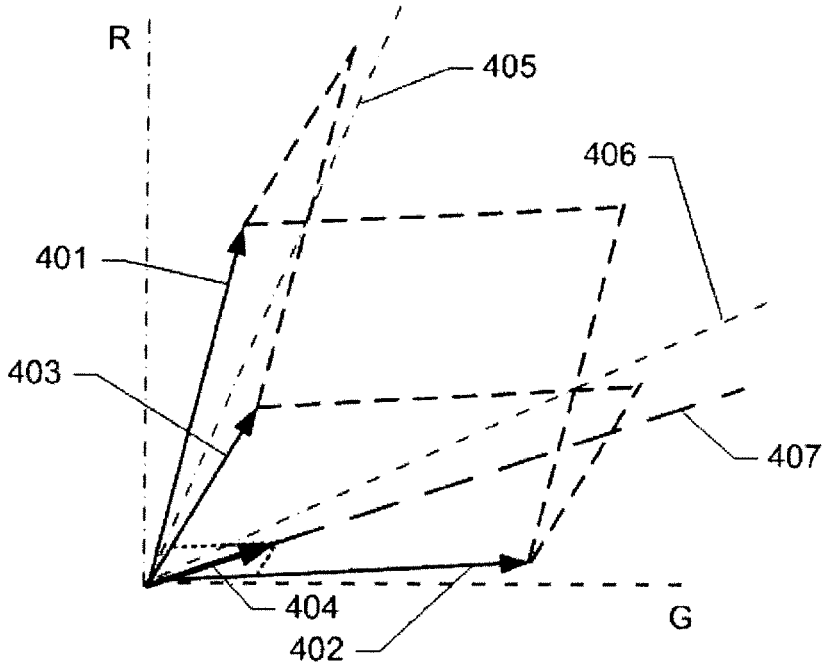
FIG. 4 illustrates an example of the calibration in an embodiment with more different-coloured light sources than primary colours.

FIG. 4 illustrates an example of the calibration in an embodiment with more different-coloured light sources than primary colours. For ease of illustration, FIG. 4 illustrates a two-dimensional colour space spanned by two primary colours R and G. However, it will be appreciated that the process may also be applied in more dimensions, in particular in three dimensions. For the purpose of FIG. 4, it is further assumed that the control process controls a variable-colour light source with three individually controllable light sources, e.g. a red LED, a green LED and a third LED having a different colour. The calibration vectors at maximum intensity obtained by the above-described calibration process are shown as vectors 401, 402, and 403, respectively. An input vector 404 may thus be expressed as many alternative linear combinations of vector 401, 402, 403. In one embodiment, the control process selects a combination of two of the calibration vectors such that the selected calibration vectors result in the largest possible maximum brightness at the given colour (i.e. in the direction 407 of the input vector 404 in colour space). Hence, in the example of FIG. 4, the control process selects the individual light sources corresponding to vectors 402 and 403 in order to generate light of the colour defined by input vector 404. In general, this selection rule allows for an efficient implementation, since the control process only needs to determine which one of the segments defined by the dashed dotted lines 405 and 406, the input vector 404 is located in. Hence, the selection process may be implemented by a simple look-up operation in a look-up table. Nevertheless, it will be appreciated that alternative and/or additional selection rules may be implemented.

Again referring to FIG. 3, the components 303 in the direction of the calibration vectors thus correspond to the desired intensities of the individual light sources in order to provide a total light output of the desired colour and intensity. Accordingly, when the control process has determined the components 303 in the direction of the calibration vectors, the process determines the required activation levels for the corresponding individually controllable light sources by applying the above-described scaling function for the corresponding calibration vector. For example, in the case of the above-described exponential scaling function, the determined components 303 are fed into the scaling function as relative input values $I_{in}$, and the output $O_{scaled}$ from the scaling function corresponds to the required activation level with which the corresponding individual light source is to be activated.

In some embodiments, the control process performs a further scaling or other transformation of the determined activation levels, e.g. based on received temperature signals as described above.

Finally, the activation levels are transformed in suitable respective activation signals, e.g. pulse width modulated current signals in case of an LED-based system, and forwarded to the respective individually controllable light sources.

Figure 5:
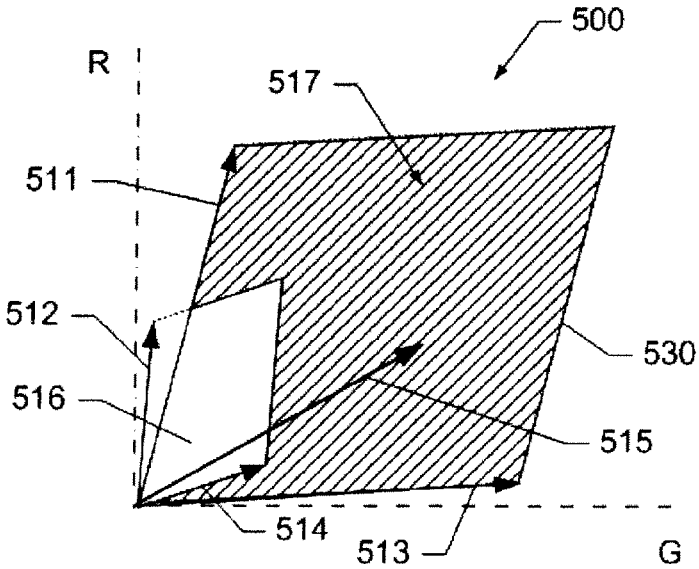
FIG. 5 schematically illustrates another example of the calibration of a variable-colour light source.

FIG. 5 schematically illustrates another example of the calibration of a variable-colour light source. This embodiment of the calibration process is similar to the process described in connection with FIGS. 3 and 4. However, while in the previous embodiment a colour measurement is only performed at one activation level for each of the individually controllable light sources, in this embodiment colour and brightness measurements are performed for more than one activation levels for each individually controllable light source. Consequently, this process results in a corresponding plurality of calibration vectors for each of the individually controllable light sources, where the calibration vectors of each of the individually controllable light sources are not necessarily parallel to each other as a result of a possible intensity dependence of the colour emitted by the individual light sources. FIG. 5 illustrates an example of such a calibration. As above, for ease of illustration, FIG. 5 shows a 2-dimensional colour space, generally designated 500, spanned by the primary colours R and G. Nevertheless, it is understood that the calibration process described herein may also be applied in higher dimensional colour spaces, in particular a three-dimensional colour space.

In particular, FIG. 5 shows calibration vectors 511 and 512 obtained from respective colour measurements at a maximum intensity and at 50% intensity, respectively, of a first one of the individually controllable colour light sources of a variable-colour light source while all other different-coloured light sources were turned off. Similarly calibration vectors 513 and 514 are obtained from corresponding measurements of a second one of the individually controllable colour light sources. Hence, the pair of calibration vectors 511 and 513 obtained at a maximum intensity of the respective individually controllable light sources defines a first range within the colour space—illustrated by the parallelogram 530—while the pair of calibration vectors 512 and 514 obtained at 50% intensity defines a second range, designated by reference numeral 516. The part of the range 530 defined by the vectors 511 and 513 that is not part of the sub-range 516 is designated by reference numeral 517.

For each of the calibration vectors 511, 512, 513, and 514, the calibration process further determines one or more brightness measurements at different activation levels. From the brightness measurements at different activation levels, the calibration process then determines respective scaling functions for each calibration vector as described above. Hence, according to this embodiment, the calibration process results in calibration data that includes two or more calibration vectors for each individually controllable light source and a scaling function associated with each calibration vector.

During subsequent operation of the calibrated control device, an embodiment of the control process receives an input colour vector 515. The control process then determines whether the input vector 515 lies in the sub-range 516. If this is the case, the process determines the components of the input vectors relative to the calibration vectors 512 and 514, and the corresponding scaling functions as described in connection with FIGS. 3 and 4. Otherwise, if the input vector 515 lies in the range 517 of the colour space (as is the case illustrated by the example of FIG. 5), the control process determines the components of the input vectors relative to the calibration vectors 511 and 513, and the corresponding scaling functions as described in connection with FIGS. 3 and 4.

In the above, an embodiment of the calibration process was described where the measurements are performed with the individual light sources activated one at a time. Alternatively, the variable-colour light source may be controlled to emit predetermined colours, e.g. the primary colours of the corresponding colour system.

The calibration process described herein may conveniently be implemented by a calibration system, an embodiment of which will now be described with reference to FIG. 6.

Figure 6:
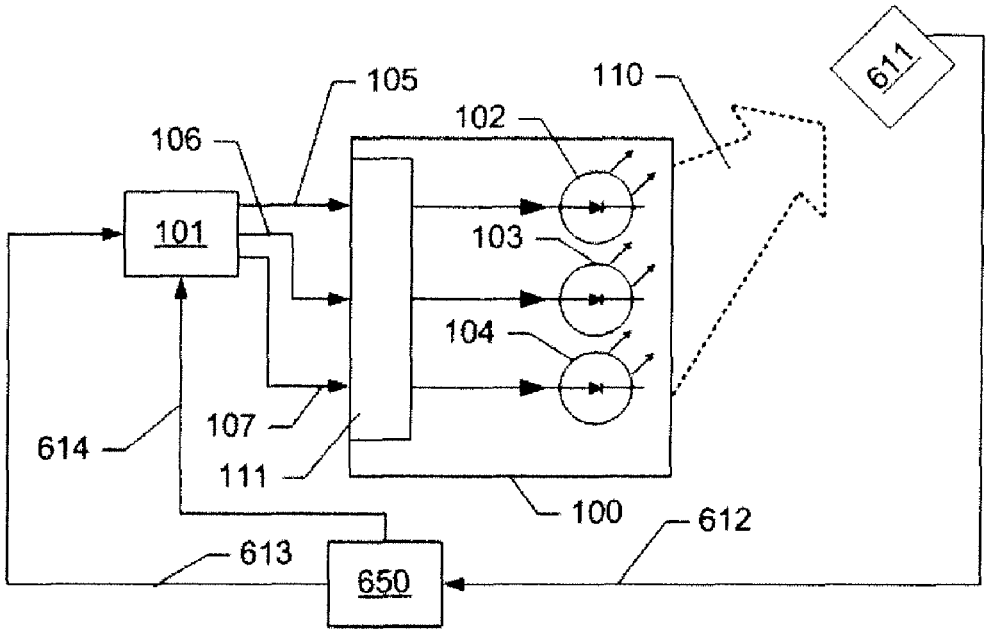
FIG. 6 schematically shows a block diagram of a system for calibrating a variable-colour light source.

FIG. 6 schematically shows a block diagram of a system for calibrating a variable-colour light source. The system includes a calibration control unit 650 and a light sensor 611 for measuring brightness and colour of the emitted light 110. The light sensor 611 is connected to the calibration control unit 650. The calibration control unit 650, e.g. a device including a suitably programmed microprocessor, or a suitably configured general purpose computer, is further connected to the control device 101 that controls the variable-colour light source 100, e.g. a control device and variable-colour light source as described in connection with FIG. 1 above.

The calibration control unit 650 is configured to send a predetermined sequence of input colour and intensity values to the control device, e.g. colour values of the primary colours red, blue and green, or colour values corresponding to the individual light sources. It will be appreciated that the calibration system may control the control device automatically when the calibration control unit 650 provides a control signal 613 that may be directly fed into the input of the control device 101. Alternatively, the calibration control unit 650 may be operated separately from the control device 101. For example, the calibration control unit may include a user interface instructing a user to enter the corresponding colour input values into the control device. In yet another embodiment, a user determines the colour values to be used for calibration and enters the corresponding values both the control device and in the calibration control unit.

For each input colour vector, the sensor 611 performs a colour and/or brightness measurement as described above. The resulting measurement signals 612 are fed into the calibration control unit. When the calibration control unit has obtained sufficiently many measurements, the calibration control unit determines the corresponding calibration data, i.e. the components of the determined calibration vectors and the corresponding scaling functions. Finally, the calibration control unit forwards the calibration data 614 to the control device 101.

Figure 7:
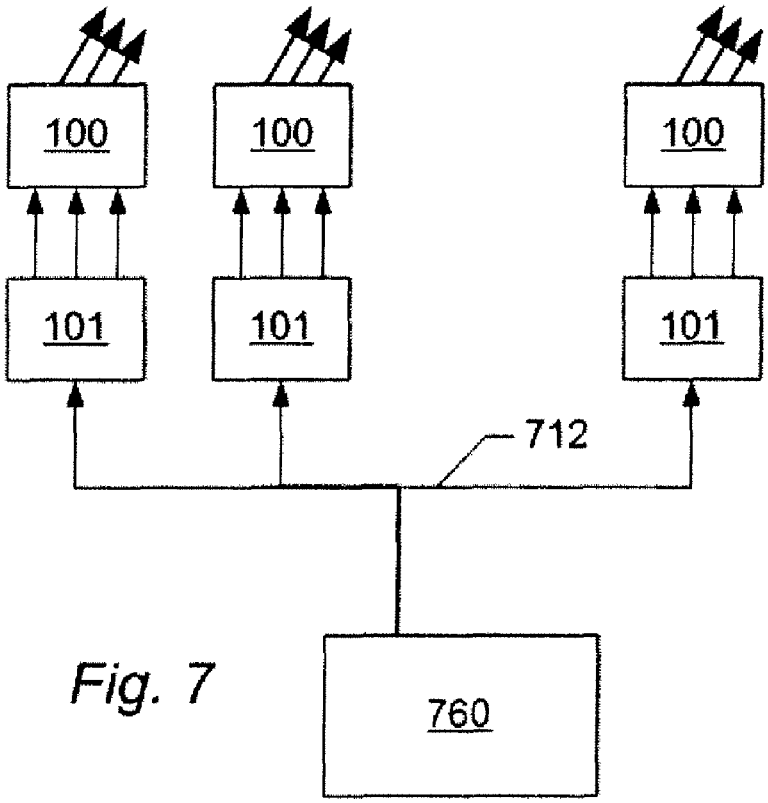
FIG. 7 illustrates a networked assembly of variable-colour light sources.

FIG. 7 illustrates a networked assembly of variable-colour light sources. The networked assembly of variable-colour light sources includes a central control system 760, e.g. a suitably programmed data processing system, and a plurality of variable-colour light sources 100, each connected to or including a corresponding control device 101 as described herein. The control devices 101 are connected to the central control system 760, e.g. via a bus system, or via another suitable wired or wireless connection. Consequently, each control device receives a colour input signal 712 for controlling the respective variable-colour light sources to generate light of a predetermined colour and brightness. The respective control devices 101 transform the received colour input signal 712 to the suitable activation signals for the individual light sources as described herein. Consequently, the central control system can send a uniform colour signal 712 to the plurality of different variable-colour light sources 100, thereby allowing a simple central control.

What is claimed is:

1. A control device for controlling a variable-colour light source, the variable-colour light source comprising a plurality of individually controllable colour light sources; where the control device is responsive to an input signal, which input signal is indicative of a colour and a brightness, where the control device comprises a control unit for generating, respective activation signals for each of the individually controllable colour light sources; which control unit comprises predetermined calibration data indicative of at least one calibration colour vector in a predetermined colour space and at least one brightness response mapping for each of the individually controllable colour light sources, wherein the control unit is configured to generate the activation signals from the input signal in relation to the predetermined calibration data;

wherein the control device is configured to obtain an input colour vector indicative of the received colour and brightness;

to determine at least one component of the input colour vector along at least one of the calibration colour vectors; and to apply a corresponding one of the brightness response mapping resulting in a corresponding one of the activation signals.

2. A control device according to claim 1, wherein the calibration data is indicative of at least two colour vectors in a predetermined colour space for each of the individually controllable colour light sources.

3. A control device according to claim 2, further comprising storage means for storing said calibration data.

4. A control device according to claim 3, further comprising an input interface for receiving said calibration data.

5. A control device according to claim 4, wherein the calibration data includes, a first calibration parameter indicative of at least one of a measured hue and a measured saturation value of the individually controllable light source for each of the individually controllable light sources.

6. A control device according to claim 5, wherein the calibration data includes, second and third calibration parameters indicative of a brightness scaling function of the individually controllable light source for each of the individually controllable light sources.

7. A control device according to claim 6, wherein the control device further comprises an input interface for receiving a temperature signal; and wherein the control unit is further adapted to compensate the generated activation signals responsive to said temperature signal.

8. A control device according to claim 7, wherein the individually controllable light sources include light emitting diodes.

9. A method of controlling a variable-colour light source, the variable-colour light source comprising a plurality of individually controllable colour light sources; the method comprising:

storing predetermined calibration data indicative of at least one set of colour values for each of the individually controllable light sources, receiving an input signal indicative of a colour and a brightness; and generating, responsive to the received input signal, respective activation signals for each of the individually controllable colour light sources;

wherein generating includes generating the activation signals from the input signal and from the predetermined calibration data by;

obtaining an input colour vector indicative of the received colour and brightness;

determining at least one component of the input colour vector along at least one of the calibration colour vectors; and applying a corresponding one of the brightness response mapping resulting in a corresponding one of the activation signals.

10. A method of calibrating a variable-colour light source, the variable-colour light source comprising a plurality of individually controllable colour light sources, the method comprising:

providing a calibration input signal indicative of a colour and a brightness to the variable-colour light source;

receiving a colorimetric measurement signal indicative of a set of measured colour values emitted by the variable-colour light source in response to the input signal, determining calibration data from the calibration input signal and the received calorimetric measurement;

storing at least one set of colour values for each of the individually controllable light sources, said set of colour values being storing indicative of said calibration data;

receiving an input signal indicative of a colour and a brightness; and generating, responsive to the received input signal, respective activation signals for each of the individually controllable colour light sources;

wherein generating includes generating the activation signals from the input signal and from the predetermined calibration data by:

obtaining an input colour vector indicative of the received colour and brightness;

determining at least one component of the input colour vector along at least one of the calibration colour vectors; and applying a corresponding one of the brightness response mapping resulting in a corresponding one of the activation signals.

* * * * *